United States Patent [19]

Hella

[11] 3,964,656

[45] June 22, 1976

[54] AIR BAR ASSEMBLY FOR WEB HANDLING APPARATUS

[75] Inventor: Terry A. Hella, Appleton, Wis.

[73] Assignee: TEC Systems, Inc., DePere, Wis.

[22] Filed: Apr. 14, 1975

[21] Appl. No.: 567,685

[52] U.S. Cl. ..... 226/97; 34/156

[51] Int. Cl.[2] ..... B65H 17/32

[58] Field of Search ..... 226/7, 97; 34/156, 160; 239/566, 600

[56] References Cited

UNITED STATES PATENTS

| | | | |
|---|---|---|---|
| 2,456,784 | 12/1948 | Jones | 239/566 X |
| 3,272,415 | 9/1966 | Wallin | 226/97 |
| 3,446,566 | 5/1969 | Miller | 239/566 X |
| 3,633,281 | 1/1972 | Vits | 226/7 |

*Primary Examiner*—Richard A. Schacher
*Attorney, Agent, or Firm*—James E. Nilles

[57] ABSTRACT

An air bar ssembly for floating and positioning a running web. The assembly includes an end fed header having a track means in which an air bar is removably slideable. An air distribution plate is also slideably removable in the header and is located between the air bar and the header proper and serves to evenly distribute air throughout the length and width of the air bar. The air bar assembly is easily disassembled for cleaning.

14 Claims, 8 Drawing Figures

AIR BAR ASSEMBLY FOR WEB HANDLING APPARATUS

BACKGROUND OF THE INVENTION

The invention pertains to apparatus for positioning and/or drying running webs such as webs of paper that have printing thereon. This apparatus is commonly referred to as air bars and they are located on opposite sides of the running web so as to hold the web suspended and without touching the air bars. Pressurized air issues from the air bars and is generally directed against the running web so as to floatingly suspend the running web.

Examples of the type of apparatus to which this invention pertain are shown in the U.S. Pat. No. 3,739,491, issued June 19, 1973 and entitled "High Velocity Air Web Dryer". Another example of prior art of this general type is shown in the U.S. Pat. No. 3,776,440 which issued Dec. 4, 1973 and entitled "Web Handling Apparatus". Still another example of the air bar itself is shown in the U.S. Pat. No. 3,549,070, issued Dec. 22, 1970 and entitled "Floatation of Sheet Material". The air bar shown in that patent, as in the present application, utilizes the Coanda effect which causes the air to issue from a slotted nozzle and then follow the contour of a Coanda surface to support the web by the air on the Coanda surface.

All of the above patents have been assigned to an assignee common with the present invention.

Air bars of the general type to which the present invention relate must distribute the air evenly throughout the length and width of the nozzle in order to provide the most desirable operating characteristics. Furthermore, as the slotted nozzles are usually very small, they are subjected to plugging by the foreign matter, such as dust found in the air passing therethrough. It is important to be able to quickly clean the nozzles and prevent down-time of the entire line of equipment in which these web handling devices are located.

SUMMARY OF THE INVENTION

The present invention provides an air bar assembly for running web handling apparatus and which supports or positions the running web and also may act to dry the material on the web. More particularly, the air bar assembly provided by the present invention includes an end-fed header which is tapered along its length so as to decrease its cross-sectional area from the air entry end of the header and towards the opposite end of the header. The header also has guide track means along its length and in which are removably slideable the air bar having air slots through which the air is directed towards the web; a perforated distribution plate is also located in the guide track means of the header and adjacent the air bar whereby the air entering the header is evenly distributed across the length and width of the air bar so as to insure more uniform distribution of pressurized air throughout the length of the air bar slots. The arrangement is such that the air bar and the distribution plate can be readily removed from the header for inspection, repair, replacement, or cleaning. The entire air bar assembly itself can be easily mounted in the air supply duct and can furthermore be easily adjusted as to its discharge angle relative to the web and can furthermore be easily adjusted as to its parallelism across the width of the running web.

Furthermore, the air bar assembly and particularly the air bar itself can be readily fabricated and assembled in an economical manner and held to the tolerances necessary in devices of this character.

These and other objects and advantages of the present invention will appear hereinafter as this disclosure progresses, reference being had to the accompanying drawings.

DESCRIPTION OF A PREFERRED EMBODIMENT

Figures 1, 2:
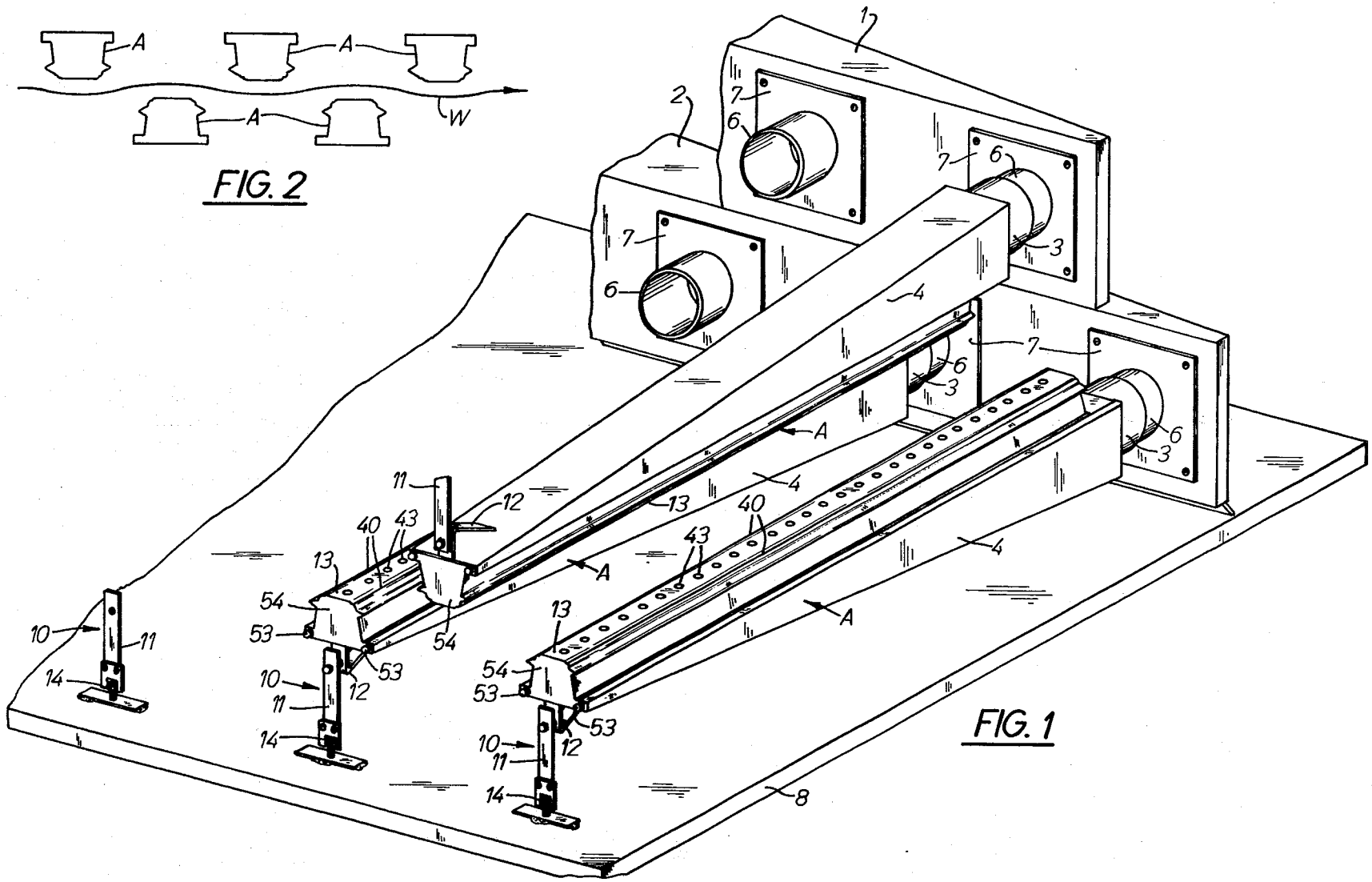
FIG. 1 is a fragmentary, perspective view of air bar assemblies made in accordance with the present invention and as connected to their respective supply ducts, certain parts being shown as broken away or removed for the sake of clarity in the drawing.
FIG. 2 is a schematic, longitudinal, cross-sectional view through an apparatus in which air bar assemblies made in accordance with the present invention are installed on opposite sides of the web and in alternately spaced relationship along the length of the web.
Figure 4:
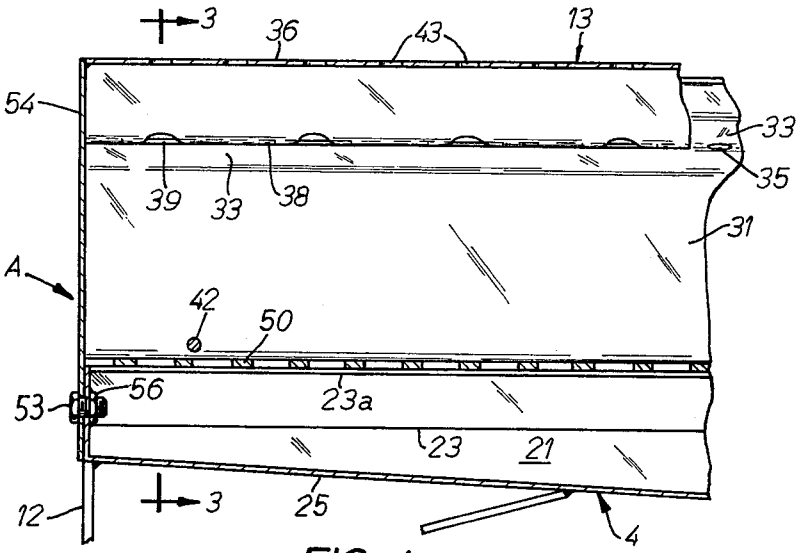
FIG. 4 is a fragmentary, longitudinal view through the outer end of the air bar shown in FIG. 3, the view being taken generally along the line 4—4 in FIG. 3.
Figure 4A:
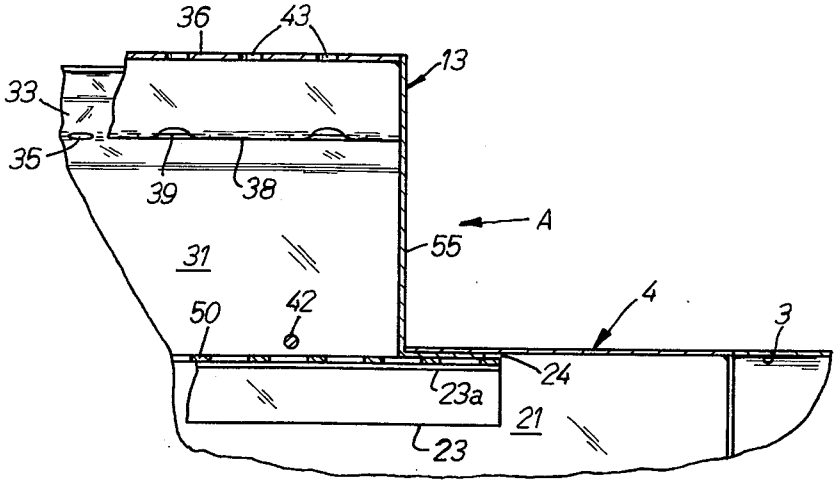
FIG. 4*a* is another longitudinal, fragmentary view of a portion of the air bar assembly shown in FIG. 3, but taken at the opposite end of the assembly from that shown in FIG. 4, that is taken adjacent the inner or supply end of the air bar assembly.

The air bar assemblies A made in accordance with the present invention are arranged in parallelism with one another and transversely with the running web and are located on opposite sides of the running web W as indicated in FIG. 2. Air supply ducts 1 and 2 are provided for supplying air under pressure to the air bar assemblies and from a source, not shown. It will be understood that the air bar assemblies are located in an enclosed chamber through which the running web passes at considerable speeds.

As shown in FIG. 1, the air bar assemblies A have an inner, round end collar 3 welded to the elongated header 4. The collar 3 is slipped over a header sleeve 6 which is welded to an air bar mounting plate 7, which in turn is rigidly secured to their respective supply ducts 1 and 2. In this manner, the entire header assembly A can be axially slid off the header sleeve 6 and it can also be rotated on the sleeve 6 so that it is properly positioned relative to the web. The other end of the assembly is adjustably secured to the framework of the apparatus such as the lower floor 8 by means of an adjustable bracket assembly 10. The bracket assembly 10 includes a strap 11 fixed to the bracket 12 which in turn is welded to the underside of the air bar. An adjustable threaded connection 14 is located between the strap 11 and the lower floor 8 so that the outer, smaller end of the air bar assembly can be vertically positioned whereby the air bar 13 of the assembly is arranged in parallelism with the transverse width of the running web.

With the above arrangement, the air is supplied through the ducts and end-wise into the pivotable air bar assemblies. The air bar assemblies can be easily removed from the supply ducts and can furthermore be easily adjusted relative to the web.

The header 4 (FIG. 3) has side walls 20 and 21 arranged in parallelism and in spaced apart relationship and which terminate at their inner edges in the inwardly turned flanges 20*a* and 21*a*, respectively, to define an elongated air discharge opening 22 along the length of the header. Secured, as by welding, within the header and adjacent each of the upper edges, are metal angle members 23 which also have inwardly turned flanges 23*a* spaced respectively from flanges 20*a* and 21*a* to form a guide track 24 therebetween and along the length of the header.

It will be noted that the header 4 has a bottom wall 25 that is tapered or inclined outwardly so that the cross-sectional area of the header reduces from the larger supply end which is adjacent the supply ducts 1 and 2, towards the outer end of the header. This in itself provides for a more even distribution of air flow throughout the length of the air bar 13, now to be described.

The air bar 13 includes side walls 30 and 31 each having outwardly extending flanges 30*a* and 31*a*, the flanges extend outwardly in opposite directions and are adapted to be slideably engaged in the guide tracks 24 of the header. The side walls 30 and 31 furthermore have outwardly extending ridges 33 that extend along the length of the walls. In the apex of the V-shaped ridges are formed a series of spaced apart apertures 35. The air bar also includes a channel 36 which has outwardly extending flanges 37 and 38 that have a series of holes 39 extending therethrough. The outer edges of the flanges 37 and 38 bear against the inside of the ridges 33 of the side walls and are rigidly secured thereto by means of spot welding which is done through the holes 35 in the side walls. Stiffeners 42 are welded between and to the side walls. Air holes 43 are spaced along the central length of the channel 36.

Figure 3:
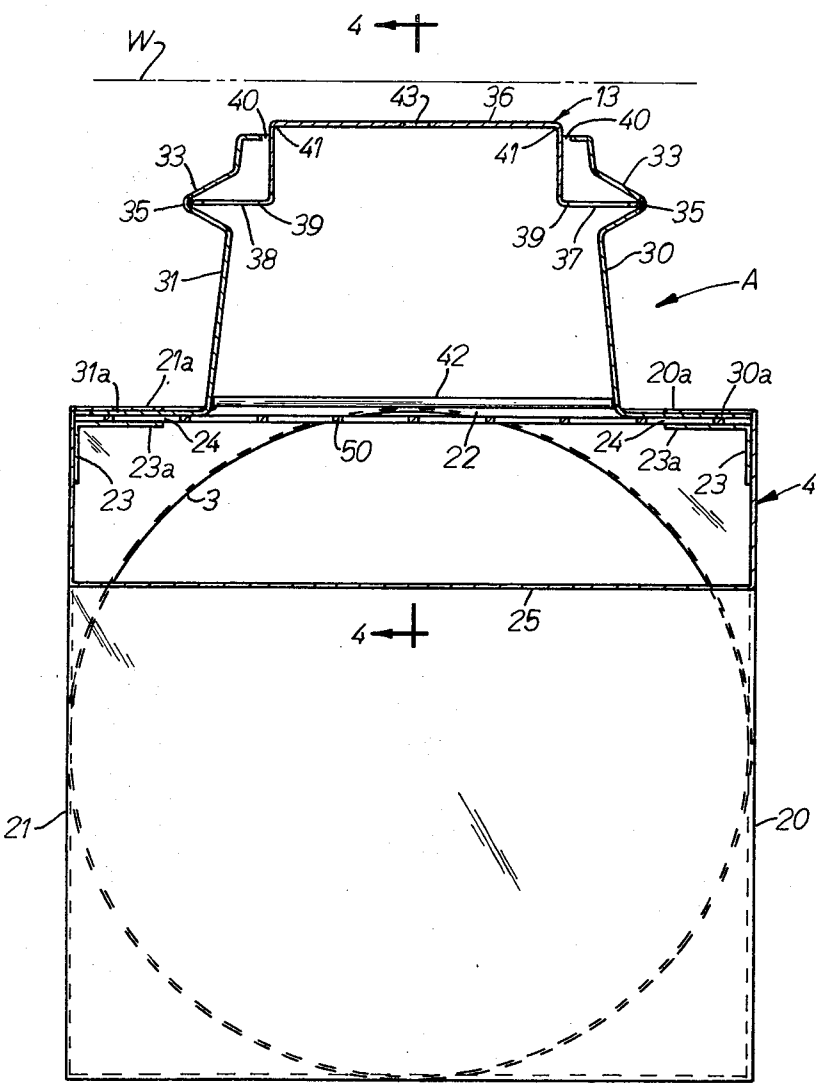
FIG. 3 is a transverse, cross sectional view through one of the air bar assemblies shown in FIG. 1, but on an enlarged scale, the view also being taken along line 3—3 as shown in FIG. 4.
Figure 5:
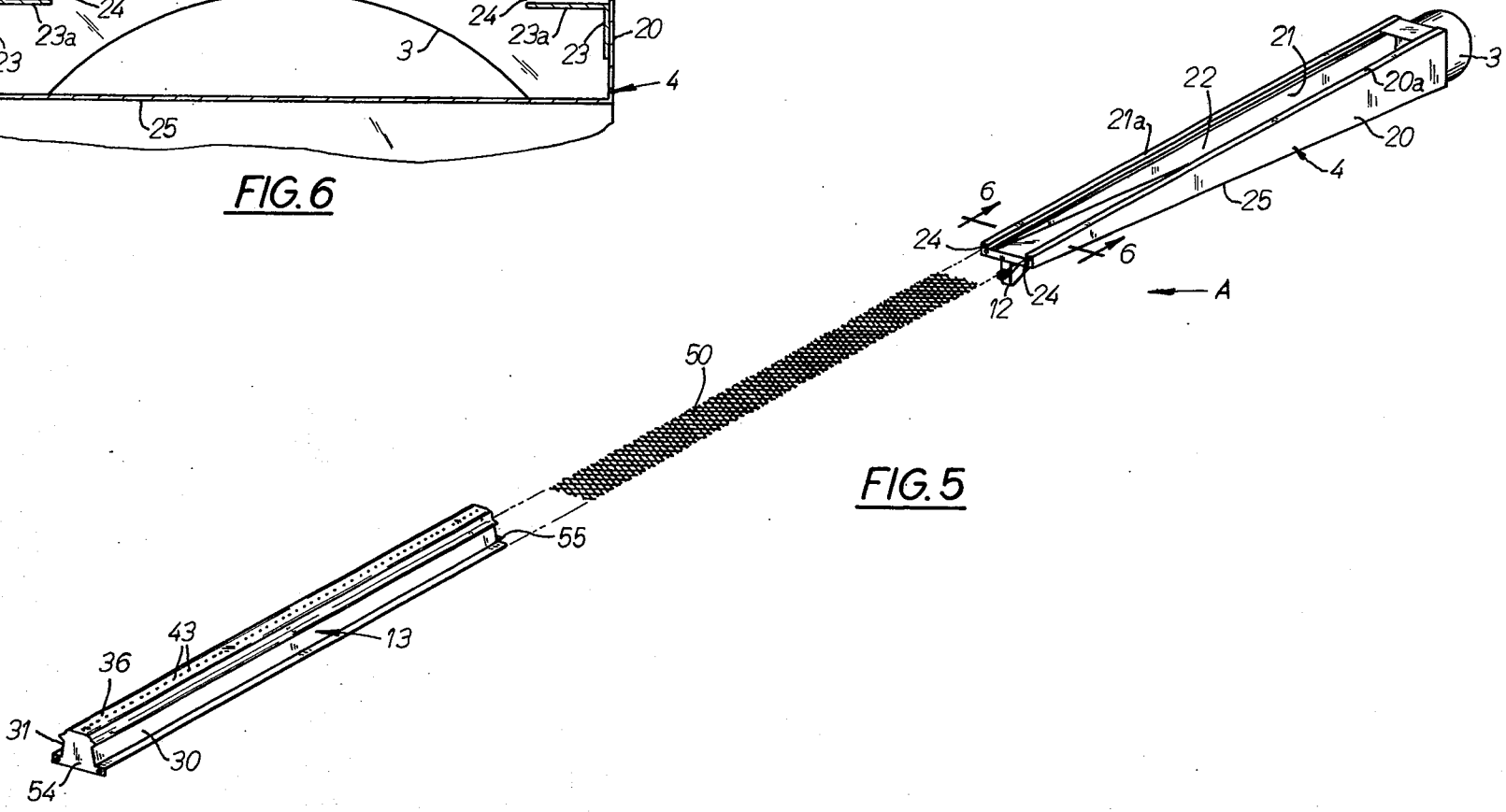
FIG. 5 is an exploded, perspective view of the air bar assembly but on a reduced scale and showing the header, distribution plate, and air bar in separate relationship.
Figure 6:
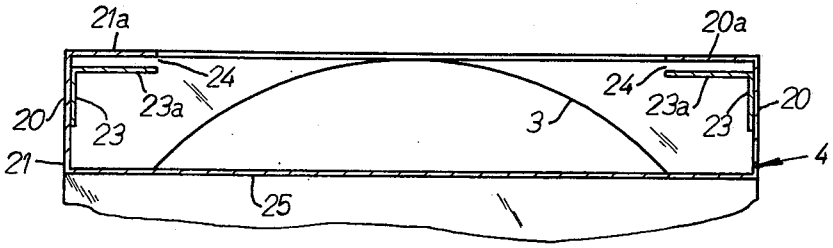
FIG. 6 is an enlarged, cross-sectional view taken generally along the line 6—6 in FIG. 5.
Figure 7:
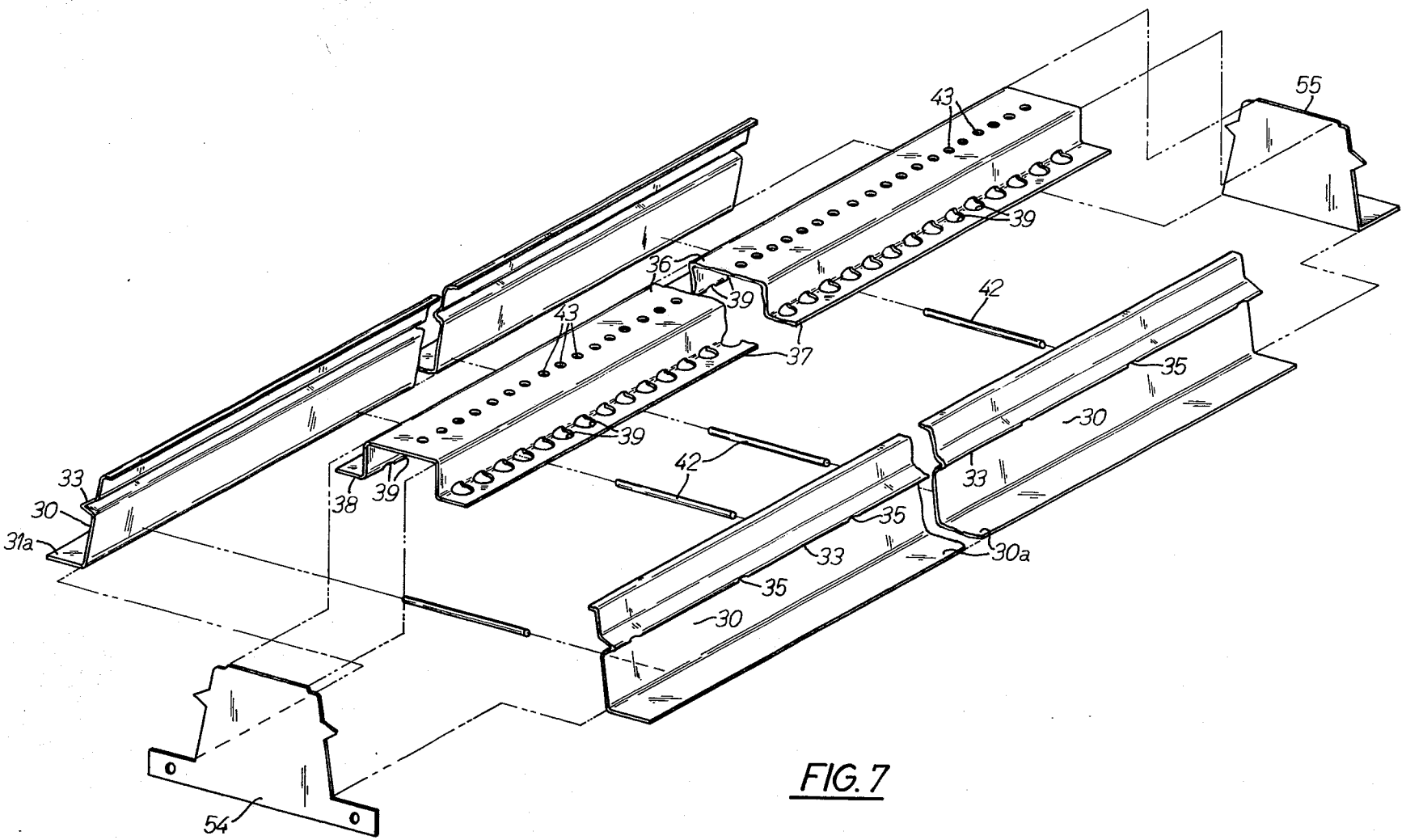
FIG. 7 is an exploded, perspective view of the air bar itself.

As shown in FIG. 3, it will be noted that air discharge nozzles or slots 40 are formed along the entire length of the air bar and adjacent the rounded corners 41 of the channel 36. Pressurized air which is fed to the interior of the air bar from the header moves evenly through the holes 39 located along their respective flanges and this air then moves outwardly through the discharge nozzle slots 40 and towards the running web W in the known manner, to thereby position or support the running web.

A distribution plate 50 is also slideably removable in the guide tracks 24 of the header, for the purpose of evenly distributing the air as it passes from the interior of the header and into the air bar. This perforated distribution plate 50 is formed from expanded metal that has been flattened after it has been cut across the width of the sheet of metal or "against the grain". The expanded metal, when flattened, acts in a very efficient manner to evenly distribute the air across the entire length and width of the air bar as the air enters the air bar from the duct. The plate 50 is preferably formed from one-quarter inch mesh stainless steel.

Thus, both the air distribution plate 50 and the air bar 13 can be slid into the track means 24 of the duct

4 and easily removed therefrom. The air bar is held captive within the header by means of the end bolts 53 that pass through the air bar end plate 54 and threadably engage nuts 56 welded to the interior of the header 4. An end plate 55 closes the other end.

Various types or styles of air bars can be inserted in the track 24 of the duct, that is to say air bars having either single or double discharge nozzles, or air bars of different cross-sectional shapes and configurations may be substituted in the track means of the duct.

I claim:

1. An air bar assembly for web handling apparatus comprising an air supply header having an elongated discharge opening along one side thereof, guide track means on said header and arranged along opposite sides of said opening, an air bar including an air discharge nozzle arranged longitudinally thereof, said air bar having means for being slideably engaged in said header track means whereby said air bar can be slideably removed in a longitudinal direction from said header.

2. The air bar assembly set forth in claim 1 including an air distribution plate slideably mounted in said header guide track means and through which air from said header passes into said air bar.

3. The assembly set forth in claim 1 further characterized in that said header has an air supply inlet end, and said header decreases in cross-sectional area along its length and in a direction away from said air supply inlet end.

4. The assembly set forth in claim 3 including a sleeve means on said header air supply inlet end for being detachably secured to an air supply duct.

5. The assembly set forth in claim 4 further characterized in that said sleeve means is round in cross-section for being rotatable about its longitudinal axis.

6. The air bar assembly set forth in claim 1 further characterized in that said air bar comprises a pair of opposite sides each having an outwardly extending ridge formed along its longitudinal length, and a generally U-shaped channel member having opposite and outwardly extending flanges which are engageable in the respective said opposite outwardly extending ridges and secured therein, said side walls and said channel defining said air discharge nozzle.

7. The air bar assembly set forth in claim 1 further characterized in that said air bar means for being slideably engaged in said header track means comprises outwardly and oppositely extending flanges for slideable engagement in said track means.

8. An air bar assembly for web handling apparatus comprising an air supply header having an elongated discharge opening along one side thereof, said header also having an air supply inlet end, said header decreasing in cross-sectional area along its length and in a direction away from said air supply inlet end, guide track means on said header and arranged along opposite sides of said opening, an air bar including an air discharge nozzle arranged longitudinally thereof, said air bar having means for being slideably engaged in said header track means whereby said air bar can be slideably removed in a longitudinal direction from said header, and an air distribution plate slideably mounted in said header guide track means and through which air from said header passes into said air bar.

9. The assembly set forth in claim 8 including a sleeve means on said header air supply inlet end for being detachably secured to an air supply duct.

10. The assembly set forth in claim 9 further characterized in that said sleeve means is rounded in cross-section for being rotatable about its longitudinal axis.

11. An air bar assembly for web handling apparatus comprising an air supply header having an elongated discharge opening along one side thereof, guide track means on said header and arranged along opposite sides of said opening, an air bar including an air discharge nozzle arranged longitudinally thereof, said air bar having means for being slideably engaged in said header track means whereby said air bar can be slideably removed in a longitudinal direction from said header, said air bar comprising a pair of opposite sides each having an outwardly extending ridge formed along its longitudinal length and a generally U-shaped channel member having opposite and outwardly extending flanges, said opposite flanges being engageable in the respective opposite outwardly extending ridges and secured therein, said side walls and said channel defining said air discharge nozzle, and an air distribution plate also slideably mounted in said header guide track means and through which air from said header passes into said air bar.

12. The assembly set forth in claim 11 further characterized in that said header has an air supply inlet end, and said header decreases in cross-sectional area along its length and in a direction away from said air supply inlet end.

13. The assembly set forth in claim 12 including a sleeve means on said header air supply inlet end for being detachably secured to an air supply duct, said sleeve means being round in cross-section so as to be rotatable about its longitudinal axis.

14. The air bar assembly set forth in claim 11 further characterized in that said air bar means for being slideably engaged in said header track means comprises outwardly and oppositely extending flanges for slideable engagement in said track means.

* * * * *